US011643755B2

(12) United States Patent
Park

(10) Patent No.: US 11,643,755 B2
(45) **Date of Patent: *May 9, 2023**

(54) HYDROPHOBIC NANO-SILICA MIXED THERMOPLASTIC POLYURETHANE COATED YARN

(71) Applicant: Heedae Park, Busan (KR)

(72) Inventor: Heedae Park, Busan (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/537,511

(22) Filed: Nov. 30, 2021

(65) Prior Publication Data

US 2022/0081805 A1 Mar. 17, 2022

Related U.S. Application Data

(62) Division of application No. 16/839,865, filed on Apr. 3, 2020.

(30) Foreign Application Priority Data

Dec. 9, 2019 (KR) ..... 10-2019-0162657

(51) Int. Cl.

| | |
|---|---|
| ***C08K 3/36*** | (2006.01) |
| ***D01F 8/16*** | (2006.01) |
| ***D01D 11/06*** | (2006.01) |
| ***D01F 9/08*** | (2006.01) |
| ***D06M 11/79*** | (2006.01) |
| ***D06M 15/564*** | (2006.01) |

(52) U.S. Cl.

CPC ..... *D01F 8/16* (2013.01); *D01D 11/06* (2013.01); *D01F 9/08* (2013.01); *D06M 11/79* (2013.01); *D06M 15/564* (2013.01); *D10B 2401/021* (2013.01); *D10B 2401/041* (2013.01)

(58) Field of Classification Search

CPC . D01F 8/16; D01F 9/08; D01D 11/06; D06M 11/79; D06M 15/564; D10B 2401/021; D10B 2401/041; C09J 175/04; C08K 3/36; D02G 3/36

USPC ..... 428/372

See application file for complete search history.

(56) References Cited

U.S. PATENT DOCUMENTS

| | | | | |
|---|---|---|---|---|
| 10,907,277 | B2 * | 2/2021 | Park | C08G 18/76 |
| 2004/0014839 | A1 * | 1/2004 | Bomal | C08K 3/01 524/425 |
| 2004/0131527 | A1 * | 7/2004 | Gottschalk-Gaudig | G03G 9/09725 423/335 |
| 2018/0100050 | A1 * | 4/2018 | Park | C08J 3/22 |

FOREIGN PATENT DOCUMENTS

| | | | |
|---|---|---|---|
| KR | 10-1318135 | B1 | 10/2013 |
| KR | 10-1341054 | B1 | 12/2013 |
| KR | 10-1341055 | B1 | 12/2013 |
| KR | 10-1561890 | B1 | 10/2015 |

* cited by examiner

*Primary Examiner* — Hannah J Pak

(74) *Attorney, Agent, or Firm* — Goldilocks Zone IP Law

(57) ABSTRACT

A thermoplastic polyurethane coated yarn having excellent adhesive strength in which hydrophobic nano-silica is mixed. The nano-silica is contained in the range of 0.2-5 parts per hundred resin (phr) and the nano-silica having a primary particle size of in a range of 1-100 nm. The thermoplastic polyurethane coating yarn mixed with the hydrophobic nano-silica of the present invention is uniformly coated with a thermoplastic polyurethane resin containing nano-silica containing a hydrophobic functional group on the surface of the core yarn, whereby the core yarn is biased to one side. Since no coating or uncoating occurs, the product quality and productivity are excellent, in addition to excellent durability and wear resistance of the thermoplastic polyurethane, mechanical strength and chemical resistance are improved.

4 Claims, 2 Drawing Sheets

【FIG. 1】
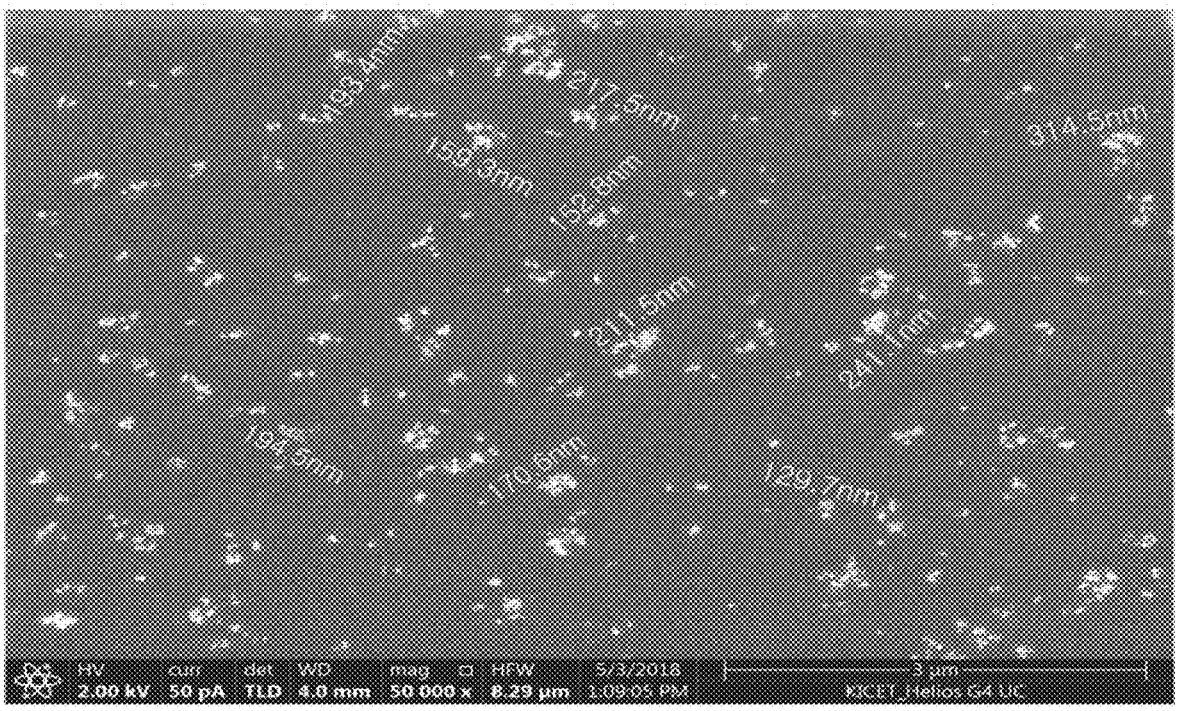
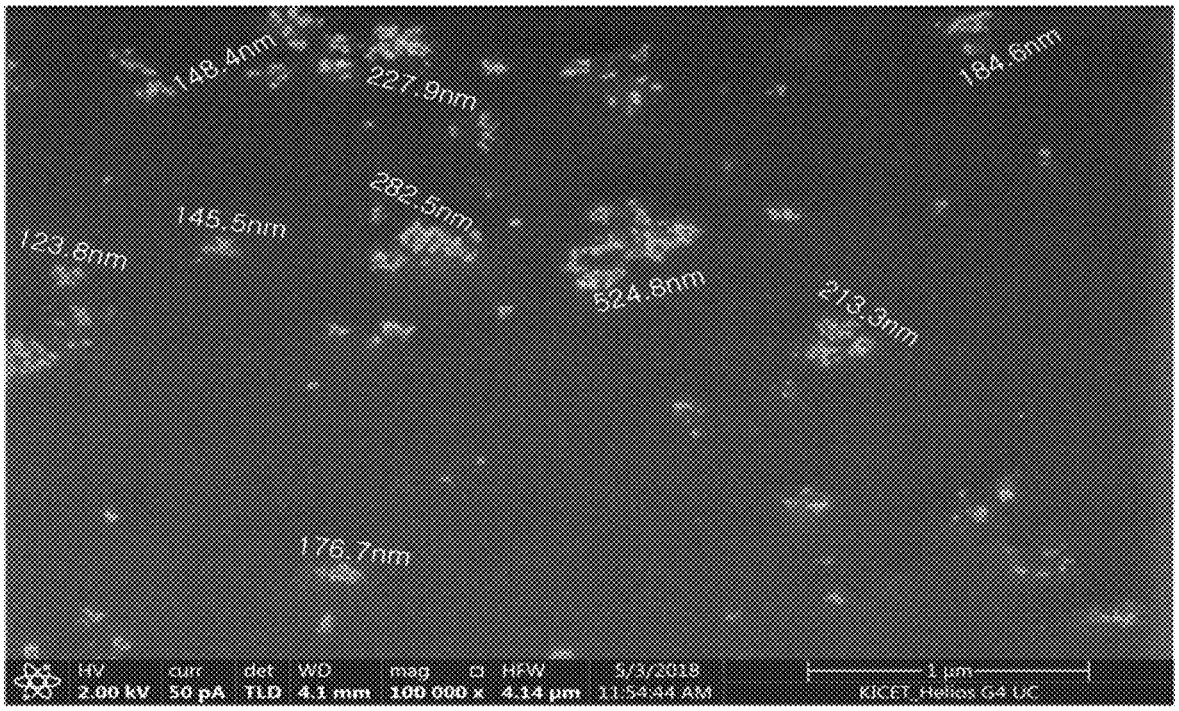

【FIG. 2】
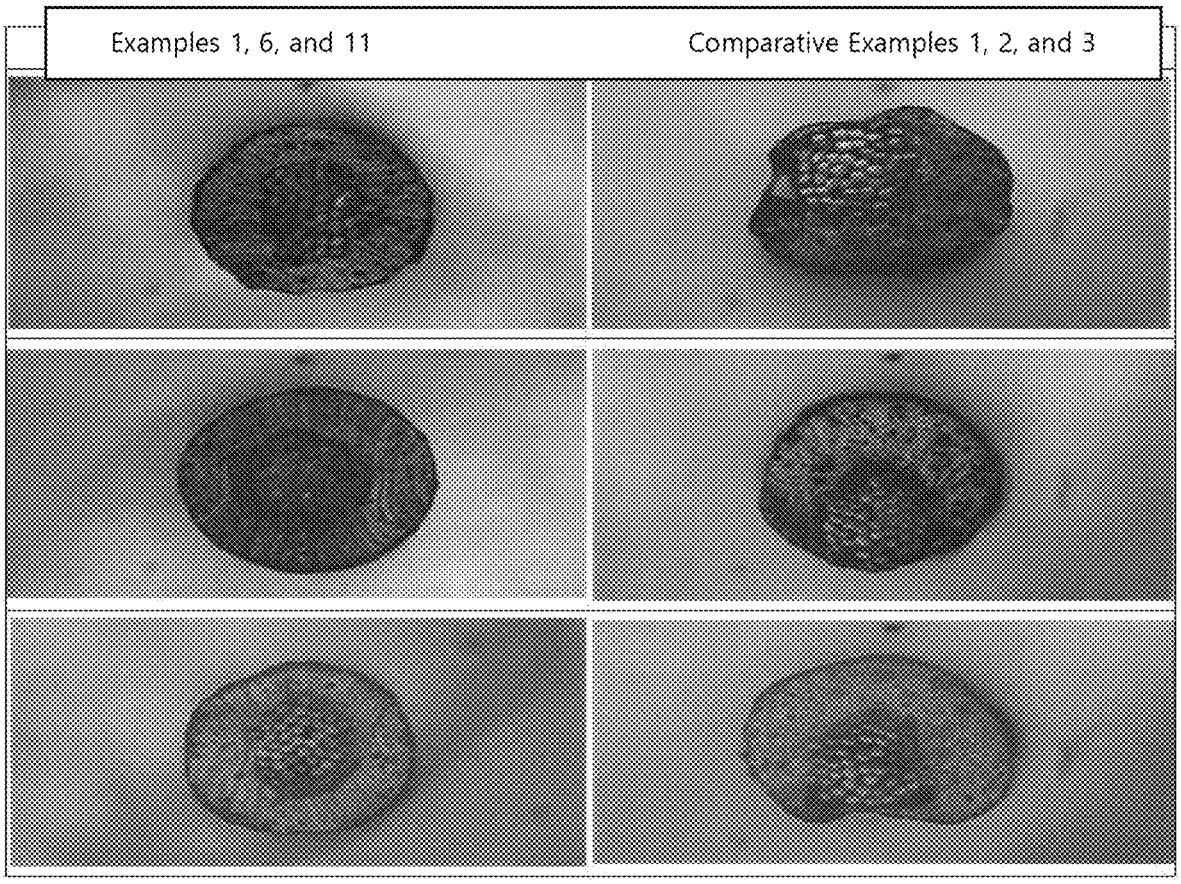

HYDROPHOBIC NANO-SILICA MIXED THERMOPLASTIC POLYURETHANE COATED YARN

CROSS-REFERENCE TO RELATED APPLICATION

This application is a Divisional application, pursuant to the provisions of 35 U.S.C. § 120, of prior U.S. patent application Ser. No. 16/839,865 titled "HYDROPHOBIC NANO-SILICA MIXED THERMOPLASTIC POLYURETHANE COATED YARN" by Heedae PARK, filed on Apr. 3, 2020, and claims priority to Korean Patent Application No. 10-2019-0162657, filed on Dec. 9, 2019, and all the benefits accruing therefrom under 35 U.S.C. § 119, the contents of which in its entirety are herein incorporated by references.

BACKGROUND TECHNOLOGY

Aspect(s) of the present invention relates to a thermoplastic polyurethane coated yarn mixed with hydrophobic nano-silica, more specifically by applying a thermoplastic polyurethane resin containing nano-silica, which contains hydrophobic functional groups, on a surface of a core yarn, the core yarn biased to one side, i.e., eccentricity, does not occur or uncoating, and excellent physical properties such as formability, wear resistance, and tensile strength. In addition, aspect(s) of the present invention relates to a thermoplastic polyurethane coated yarn mixed with hydrophobic nano-silica, which can realize antifouling, scratch resistance, and soft touch.

BACK GROUND OF THE TECHNOLOGY

Recently, in order to produce sporting goods, household goods, industrial products such as shoes, clothing, bags, blinds, flooring, etc., mainly yarns such as polyester, nylon, PBT, acrylic, etc. are used. However, since the yarns are somewhat vulnerable to mechanical or chemical strength and heat, a coated yarn having a coating layer formed on the surface of the yarn may be used.

Such coated yarn is processed by coating a thermoplastic resin such as polyvinyl chloride (PVC), polypropylene (PP), and polyurethane (PU) on the surface of the yarn in a die using a conventional extruder.

Although many coated yarn with increased durability, wear resistance and adhesion are used, there were problems such as difficulty in adjusting the amount of application when ordinary thermoplastic is used, especially when a small amount of application is not possible to manufacture coating material with a thickness of less than 350 denier, a thin denier.

Due to the above difficulties in the manufacturing process, the coating material lacks durability and wear resistance, so creating a blind or a flooring material as well as shoes, garments, and bag materials will cause short usage.

In order to improve the situation, the inventor of the present invention has presented the technology to add hydrophobic nano-silica to thermoplastic polyurethane resin, so that the thermoplastic polyurethane injection reach the completion stage, see Korean Patent Registration No. 10-1971849, entitled "thermoplastic polyurethane Thermoplastic Polyurethane Yarn," and dated on Apr. 17, 2019.

However, the thermoplastic polyurethane coated yarns in the patent were frequently eccentric and uncoated, and the color dispersion was not enough resulting in the shading phenomenon. Even though the coats were equally manufactured, the presence of color difference on the fabric was not only the biggest problem but also the insufficiency in anti-corrosion, anti-scratch, and molding, thus it needed improvement.

The present inventor has continuously studied to solve the problem of the coating yarn, through Patent No. 10-1318135, entitled, "a composition of coated raw polyurethane compound, and dated on Oct. 15, 2013" has been developed, which includes: a thermoplastic polyurethane, a thickener used by selecting any one of inorganic materials such as silica, talc, and calcium carbonate ($CaCO_3$), and an olefin-based coupling agent, in addition, in Korean Patent No. 10-1341054, entitled, "a method of manufacturing a coated yarn," and dated on Dec. 13, 2013, has been developed, which includes: a step of preparing a compound by mixing the thermoplastic polyurethane and the thickener, and then melted and kneaded, and dried and matured again; after melting the compound, a method of manufacturing a coated yarn, coating the molten compound any one selected from polyester, nylon, and spandex on the surface of the yarn.

In addition, under Korean Patent Registration No. 10-1341055, entitled "composition of thermoplastic polyurethane yarn and method for manufacturing the same," and dated on Dec. 13, 2013, there is a method of manufacturing thermoplastic polyurethane yarn, the method including: mixing thermoplastic polyurethane with additives and processing agents, melting them, mixing them, and then drying and maturing them again into a compound. By injecting the above compound into an extruder and simultaneously injecting any one resin selected from thermoplastic polyurethane, polyester, nylon and acrylic into another extruder, the interior is formed from any one resin selected from the thermoplastic polyurethane, polyester, nylon, acrylic and the exterior is formed of the thermoplastic polyurethane compound, thus forms a multi-layer structure.

Korean Patent No. 10-1561890, entitled "aqueous thermosetting urethane compound for yarn coating and method of manufacturing coated yarn using the same," dated on Oct. 14, 2015, disclosed is an aqueous thermosetting urethane compound for yarn coating and a method of manufacturing a coated yarn coated with the same, characterized in that the yarn coating compound comprises an aqueous thermosetting urethane resin and has pores.

As described above, the present inventors research and develop polyurethane coated yarn which is excellent in wear resistance, adhesiveness, waterproofness, molding property, etc., since such coated yarns must have a core such as polyester or nylon, there is a limitation in thickness, which makes it impossible to produce a thin coated yarn and also causes eccentricity to one side and uncoating of the core yarn, there is still a problem in the productivity and quality of the coating yarn.

RELATED DOCUMENTS

Patent Documents

Patent Document 1: Korean Patent No. 10-1318135, entitled, "a composition of coated raw polyurethane compound, and dated on Oct. 15, 2013;

Patent Document 2: Korean Patent No. 10-1341054, entitled, "a method of manufacturing a coated yarn," and dated on Dec. 13, 2013;

Patent Document 3: Korean Patent No. 10-1341055, entitled "composition of thermoplastic polyurethane yarn and method for manufacturing the same," and dated on Dec. 13, 2013; and Patent Document 4: Korean Patent No. 10-1561890, titled "aqueous thermosetting urethane compound for yarn coating and method of manufacturing coated yarn using the same," dated on Oct. 26, 2015.

DESCRIPTIONS OF THE INVENTION

An object of the present invention, uniform coating of thermoplastic polyurethane resin containing nano-silica containing hydrophobic functional groups on a surface of a core yarn prevents the core yarn from biasing and uncoating, which not only has excellent physical properties such as wear resistance, adhesiveness, color dispersion, antifouling property, scratch resistance, and molding property, but also realizes a soft and light feel.

Means for Solving the Problems

According to aspect of the present invention, a thermoplastic polyurethane coated yarn mixed with hydrophobic nano-silica is a coated yarn in which a thermoplastic polyurethane resin is coated on a surface of a core yarn, the thermoplastic polyurethane resin contains a nano-silica, which contains a hydrophobic functional group on the surface in a range of 0.2-5 Parts per Hundred Resin (phr), the nano-silica has the primary particle size of 1-100 nm.

According to a preferred embodiment of the present invention, the hydrophobic functional group contained in the surface of the nano-silica is any one or more selected from alkyl group, dimethyl group, trimethyl group, dimethyl siloxane group, and methacryl group, the nano-silica forms a nano-silica aggregate which has an aggregate size of an average from 100 to 1200 nm.

In addition, the core yarn is any one selected from polyester, nylon, acrylic, polyurethane, polyolefin, carbon fiber, glass fiber, and metal fiber and the thermoplastic polyurethane coated yarn has a thickness, an outer diameter, in a range of 0.1 to 5 mm.

According to one embodiment of the present invention, the method for producing a thermoplastic polyurethane coated yarn mixed with hydrophobic nano-silica may include: selecting any one or more of a liquid raw material consisting of polyol, isocyanate and low molecular weight glycol, injecting and dispersing nano-silica particles including hydrophobic functional groups on a surface thereof, preparing a thermoplastic polyurethane resin for yarn coating by polymerizing the liquid raw material in which nano-silica particles including the hydrophobic functional group are dispersed, and melting and extruding the thermoplastic polyurethane resin for yarn coating, and coating the surface of the core yarn.

According to another embodiment of the present invention, a method for preparing a thermoplastic polyurethane coated yarn mixed with a hydrophobic nano-silica may include: preparing a thermoplastic polyurethane master batch containing nano-silica including a hydrophobic functional group on a surface thereof, compounding the masterbatch with a thermoplastic polyurethane base resin to produce a thermoplastic polyurethane resin for yarn coating, and melting and extruding the thermoplastic polyurethane resin for yarn coating, and coating the surface of the core yarn.

Effects of the Invention

The thermoplastic polyurethane coating yarn mixed with the hydrophobic nano-silica of the present invention is uniformly coated with a thermoplastic polyurethane resin containing nano-silica containing a hydrophobic functional group on a surface of a core yarn, which the product quality and productivity are excellent as the core yarn is neither eccentricity nor uncoating.

In addition, an excellent durability and wear resistance of the thermoplastic polyurethane, mechanical strength and chemical resistance are improved.

In addition, the fiber fabric and the molded article made of the coated yarn of the present invention have advantages that can be applied to various products, such as sporting goods, household goods and industrial goods, as they are excellent in wear resistance, adhesiveness, color dispersion, antifouling, scratch resistance, and molding and can realize a softer and lighter texture.

BRIEF DESCRIPTIONS OF THE DRAWINGS

FIG. 1 is a SEM photograph of the surface of the thermoplastic polyurethane coated yarn according to an aspect of the present invention.

FIG. 2 is an electron micrograph comparing the cross section of the thermoplastic polyurethane coated yarn according to an aspect of the present invention and a comparative example.

DETAILED DESCRIPTIONS OF THE INVENTION

In the following description of the thermoplastic polyurethane coated yarn mixed with hydrophobic nano-silica according to aspect(s) of the present invention, which is intended to illustrate the invention to those skilled in the art to easily practice the invention. This does not mean that the technical ideas and categories of this invention are limited.

A "nano-silica" used in aspect(s) of the present invention refers to silica particles of several hundred nanometers, nm, or less in size of primary particles smaller than micrometers, μm.

The nano-silica, a hydrophobic nano-silica, having a hydrophobic functional group on its surface means that a hydrophobic functional group is introduced to a part or all of the surface of the nano-silica particle.

Conventional nano-silica particles are hydrophilic on the surfaces thereof, the nano-silica of aspect(s) of the present invention is introduced by a hydrophobic functional group (lipophilic) through a separate surface treatment or surface modification, so that the surface of the particle is hydrophobic, excellent dispersibility and the water resistance of the thermoplastic polyurethane coated fiber itself is reinforced.

In addition, the "nano-silica aggregate" used in aspect(s) of the present invention refers to a state in which about 70% or more of the nano silica primary particles are strongly aggregated together by physical and chemical actions.

The nano-silica aggregate is composed of one or more primary particles, and it is difficult to further separate the nano-silica aggregates into smaller entities, nano-silica particles, in the thermoplastic polyurethane resin for yarn coating.

A "Thermoplastic polyurethane coated yarn" used in aspect(s) of the present invention is a concept distinguished from a yarn manufactured by directly spinning the thermoplastic polyurethane itself, it refers to a coated yarn produced by coating a thermoplastic polyurethane resin on the surface of a core yarn such as a polyester yarn.

The thermoplastic polyurethane resin used in the thermoplastic polyurethane coated yarn of aspect(s) of the present invention is a virgin thermoplastic polyurethane, virgin TPU, which is obtained by polymerizing polyol and isocyanate as raw materials and low molecular weight glycol as a chain extender.

Examples of the polyol used herein may include any one of polyester glycols, polyether glycols, polycaprolactones, and the like, and examples of the isocyanates may include any one of aromatic isocyanates and aliphatic isocyanates, and examples of low molecular weight glycols may include 1,4-butanediol and the like.

The thermoplastic polyurethane resin may be a thermoplastic polyurethane obtained by mixing the virgin thermoplastic polyurethane (virgin TPU) prepared as described above with the thermoplastic polyurethane scrap remaining after high frequency work or hot melt processing.

According to aspect(s) of the present invention, a thermoplastic polyurethane resin for yarn coating prepared by mixing thermoplastic polyurethane and hydrophobic nano-silica and compounding the mixed thermoplastic polyurethane and hydrophobic nano-silica by an extruder may apply the thermoplastic polyurethane resin for yarn coating to a core yarn surface.

The thermoplastic polyurethane resin for the yarn coating may produce various hardness thermoplastic polyurethanes according to the content of the raw material, and after then, it is possible to realize various color thermoplastic polyurethanes by adding a various color master batch when extruding the coating yarn.

Accordingly, the thermoplastic polyurethane coated yarn mixed with a hydrophobic nano-silica according to aspect(s) of the present invention is a coated yarn coated with a thermoplastic polyurethane resin on the surface of the core yarn, the thermoplastic polyurethane resin may contain a nano-silica in a range of 0.2-5 Parts per Hundred Resin (phr) containing a hydrophobic functional group on the surface of the core yarn. Wherein the primary particle size of the nano-silica is in a range of 1-100 nm.

The primary particle size of the nano-silica refers to the particle size of non-aggregated state.

When the content of the hydrophobic nano-silica is less than 0.2 phr based on the thermoplastic polyurethane resin, effects such as water resistance and mechanical strength are insignificant, if it exceeds 5 phr, the surface of the coated yarn may be opaque, and the adhesion and formability to a core yarn may be deteriorated.

On the other hand, when the size of the primary particles of the hydrophobic nano-silica is less than 1 nm or more than 100 nm may be problems in dispersibility or cohesion.

As above, the thermoplastic polyurethane coated yarn of aspect(s) of the present invention may contain nano-silica particles having a hydrophobic functional group on the surface of the core yarn.

When the nano-silica particles are introduced with hydrophobic functional groups on the surface, the eccentricity or uncoating of the core yarn, which may be caused by moisture in the spinning or coating process, is reduced, and excellent mechanical strength and chemical resistance, together with excellent durability and abrasion resistance of the thermoplastic polyurethane.

The fiber fabric and the molded article made of the coated yarn according to aspect(s) of the present invention have advantages that can be applied to various of products, such as sporting goods, household goods and industrial goods, as they are excellent in wear resistance, adhesiveness, color dispersion, antifouling, scratch resistance, and molding and can realize a softer and lighter texture.

Hydrophobic functional groups that can be introduced to surfaces of the nano-silica particles, which may include an alkyl group, dimethyl group, trimethyl group, dimethyl siloxane group, and methacryl group, for example, the nano-silica particles contained in the yarn-coated thermoplastic polyurethane according to aspect(s) of the present invention may include a dimethyl group on the surface of the nano-silica particles by treating the nano-silica obtained by adjusting the temperature and pressure in a fumed silica manufacturing process with an organosilane compound.

The nano-silica particles introduced with the hydrophobic functional group preferably may have an OH group density of 1.0 OH/nm$^3$ or less.

The density of the OH group can be measured by a known method, such as measuring the molar absorbance, ε, of the OH stretching oscillation band in the organosilanol group at 3750 cm$^{-1}$ using IR spectroscopy by reacting nanosilica particles and lithium aluminium hydrohydride with hydrophobic actuators.

Nano-silica particles, in which the hydrophobic functional groups are introduced according to aspect(s) of the present invention, exist in a nano-silica aggregate state, and they are dispersed in the aggregate state that is difficult to separate separately in the thermoplastic polyurethane for yarn coating.

Preferably, the aggregates have an aggregate size of 100 to 1200 nm on average, more preferably have an average aggregate size of 200 to 500 nm.

When the size of the hydrophobic nano-silica aggregate is more than 100 nm on the average, the dispersion of nano-silica is well achieved, but when it exceeds 1200 nm, the thickening effect is reduced, a defective phenomenon may occur in a coating process using a T-die extruder.

A size of the nano-silica aggregate indicates a length in a long axis direction of the nano-silica aggregate and can be measured using a scanning electron microscope (SEM).

As an example, FIG. 1 is a photograph of a 0.15 mm thick coated yarn mixed with 1 phr of a hydrophobic nano-silica, which has an average primary particle size of about 20 nm and contains a dimethyl group as a hydrophobic functional group on the surface of the nano-silica measured by Scanning Electron Microscope (SEM).

The nano-silica within the TPU resin is found to be well dispersed into nano-silica aggregates of a certain size.

In addition, the core yarn used in aspect(s) of the present invention is any one selected from polyester, nylon, acrylic, polyurethane, polyolefin, carbon fiber, glass fiber, and metal fiber, which are generally used.

It was confirmed that the thermoplastic polyurethane coated yarn manufactured therefrom can be adjusted to 0.1 to 5 mm in thickness, an outer diameter, depending on the application.

That is, a thickness of the core yarn and a thermoplastic polyurethane coating layer is formed in a range of 0.05-4 mm, respectively, thereby obtaining a coating yarn meeting objects of aspect(s) of the present invention.

The manufacturing method of the thermoplastic polyurethane coated yarn containing the hydrophobic nano-silica of the present invention is approximately two.

The first method is a method of melt extruding the yarn-coated thermoplastic polyurethane resin including injecting hydrophobic nano-silica into a liquid raw material of a thermoplastic polyurethane resin and polymerizing the same, and applying it to a surface of the core yarn.

Another method is to melt-extrude a thermoplastic polyurethane resin for yarn coating prepared by compounding a thermoplastic polyurethane masterbatch containing hydrophobic nano-silica with a thermoplastic polyurethane base resin and apply it to the surface of the core yarn. Finally, the content of nano-silica based on the thermoplastic polyurethane resin for yarn coating is preferably contained in the range of 0.2-5 phr.

The first production method may include: selecting any one or more of a liquid raw material consisting of polyol, isocyanate, and low molecular weight glycol injecting and dispersing nano-silica containing hydrophobic functional groups on the surface thereof, preparing a thermoplastic polyurethane resin for yarn coating by polymerizing a liquid raw material in which nano-silica containing the hydrophobic functional group is dispersed, melting and extruding the yarn-coated thermoplastic polyurethane resin, and coating the surface of the core yarn.

The second manufacturing method may include: preparing a thermoplastic polyurethane master batch containing nano-silica containing a hydrophobic functional group on its surface, compounding the masterbatch with a thermoplastic polyurethane base resin to prepare a thermoplastic polyurethane resin for yarn coating, and coating on the surface of a core yarn by a melt extrusion the thermoplastic polyurethane resin for yarn.

Below is a method of manufacturing a TPU resin for yarn coating by adding hydrophobic nano-silica to a liquid raw material during TPU polymerization, a direct method, and a manufacturing method of a TPU resin for yarn coating, a master batch method by compounding hydrophobic nano-silica and TPU to prepare a master batch, and compounding the masterbatch with a TPU base resin, was described in detail step by step.

A thermoplastic polyurethane coated yarn containing hydrophobic nano-silica is obtained by melt extruding the yarn-coated TPU resin prepared by the above method and applying it to the surface of the core yarn, such as polyester, nylon, acrylic, polyurethane, polyolefin, carbon fiber, glass fiber, metal fiber and other high strength yarn.

1. Manufacture of TPU Resin for Raw Coating, a Direct Method

Step 1: Preparing liquid raw materials for conventional TPU pellet polymerization, specifically polyol, isocyanate, short chain glycol, etc Step 2: Selecting any one or more of the liquid raw materials prepared in Step 1, adding hydrophobic nano-silica and knead it. For example, invention, nano-silica is dispersed by mixing and kneading with a polyol according to aspect(s) of the present.

Step 3: In the second step, polymerizing the TPU pellets the liquid raw material sufficiently dispersed with nano-silica and the remaining raw materials by simultaneously introducing into a reaction extruder.

Step 4: In the step 3, preparing a TPU resin for yarn coating by drying and aging the polymerized TPU pellets.

2. Manufacture of TPU Resin for Yarn Coating, a Master Batch Method

Step 1: measuring polymerized TPU from the liquid raw material, and hydrophobic nano-silica shown in step 1 above, by content, and making sure the content of the nano-silica not exceeding a maximum of 40% by weight.

Step 2: inputting the prepared TPU and hydrophobic nano-silica in step 1 into conventional mixer, and kneading.

Step 3: compounding the dispersed TPU in the step 2 by kneading with hydrophobic nano-silica by a conventional twin extruder.

Step 4: forming pellets by inputting the compounded TPU resin in step 3 into cooling water.

Step 5: During the above 4 steps, drying and aging the prepared pellet form, the masterbatch, in step 4, in a conventional manner.

Step 6: preparing a TPU resin for yarn coating by compounding the prepared master batch in step 5 with the TPU base resin.

Examples 1 to 11 and Comparative Examples 1 to 3

In Table 1 below, the thermoplastic polyurethane resin was melt-extruded and applied to a surface of the polyester core yarn having a thickness of 0.15 mm, to show the results of varying the content of hydrophobic nano-silica with respect to the thermoplastic polyurethane coated yarn. Here, MFI means a melt flow index.

TABLE 1

| Classification | MFI(200° C., 2.16 kg, g/10 min) | hydrophobic nanosilica content (phr) | Surface condition and extrusion processability of TPU coated yarn |
|---|---|---|---|
| 1 Comparative Example 1 | 35.5 | 0 | Uncoated Surface, Bad Eccentricity |
| 2 Example 1 | 37.1 | 0.2 | coated Surface, good Eccentricity |
| 3 Example 2 | 35.9 | 0.5 | coated Surface, good Eccentricity |
| 4 Example 3 | 36.0 | 1.0 | coated Surface, good Eccentricity |
| 5 Example 4 | 34.7 | 1.5 | coated Surface, good Eccentricity |
| 6 Example 5 | 33.8 | 2.0 | coated Surface, good Eccentricity |
| 7 Example 6 | 34.3 | 2.5 | coated Surface, good Eccentricity |
| 8 Example 7 | 35.9 | 3.0 | coated Surface, good Eccentricity |
| 9 Example 8 | 37.2 | 3.5 | coated Surface, good Eccentricity |
| 10 Example 9 | 38.0 | 4.0 | coated Surface, good Eccentricity |
| 11 Example 10 | 36.4 | 4.5 | coated Surface, good Eccentricity |
| 12 Example 11 | 36.9 | 5.0 | coated Surface, good Eccentricity |
| 13 Comparative Example 2 | 35.2 | 5.5 | Uncoated Surface, Bad Eccentricity |
| 14 Comparative Example 3 | 34.6 | 6.0 | Uncoated Surface, Bad Eccentricity |

According to Table 1 above, thermoplastic polyurethane, which does not contain hydrophobic nano-silica or contains less than 0.2 phr, flowed so well during extrusion that it was impossible to uniform coating of the surface of the core. In addition, even when the content of the hydrophobic nano-silica was more than 5 phr, the core yarn deviated to one side or the surface uncoated of the core yarn occurred.

As a result of confirming the cross-sectional state of the coating yarn using an electron microscope possessed in my company, as shown in FIG. 2, the coating yarn according to aspect(s) of the present invention confirmed that the coating yarn was stably produced in a circular shape without deviating to one side and without eccentricity by making the flow of the thermoplastic polyurethane stable by using an appropriate amount of hydrophobic nano-silica.

However, if there is too little or too much hydrophobic nano-silica, the flow of the thermoplastic polyurethane becomes unstable, which causes the shape of the coating yarn to be distorted and eccentricity to the core yarn. Even, the core yarn was exposed to the outside.

Due to the action and properties of these hydrophobic nano-silica, the coated yarn coated with the thermoplastic polyurethane resin according to aspect(s) of the present invention and the fiber fabric and the molded article produced therefrom have high durability, excellent abrasion resistance, adhesiveness, color dispersibility, stain resistance, scratch resistance, molding resistance, etc. therefore, it can be applied to a variety of products, such as sporting goods, household goods, industrial products.

From the experimental results of the Table 1 and FIG. 2, the thermoplastic polyurethane coating yarn mixed with the hydrophobic nano-silica prepared according to aspect(s) of the present invention may be substituted, modified, and changed in various forms without departing from the technical spirit of the present invention. As a possible, it can be used in various uses and forms as a functional material, such as various sports goods, household goods, industrial products, such as shoes, clothing, bags, blinds, and flooring.

What is claim is:

1. A thermoplastic polyurethane (TPU) coated yarn with hydrophobic nano-silica, wherein a thermoplastic polyurethane (TPU) resin is coated on a surface of a core yarn, the coated yarn comprising:

the core yarn having the surface, wherein the thermoplastic polyurethane (TPU) resin contains a nano-silica in a range of 0.2-5 Parts per Hundred Resin (phr), and the nano-silica includes a hydrophobic functional group on the surface thereof, wherein the nano-silica has a primary particle size in a range of 1-100 nm, and wherein the nano-silica forms a nano-silica aggregate having an average aggregate size in a range of 100-1200 nm.

2. The TPU coated yarn with hydrophobic nano-silica of claim 1, wherein the hydrophobic functional group contained on the surface of the nanosilica particles is any one or more selected from the group consisting of alkyl group, dimethyl group, trimethyl group, dimethyl siloxane group, and methacryl group.

3. The TPU coated yarn with hydrophobic nano-silica of claim 1, wherein the core yarn is any one selected from the group consisting of polyester, nylon, acrylic, polyurethane, polyolefin, carbon fiber, glass fiber, and metal fiber.

4. The TPU coated yarn with hydrophobic nano-silica of claim 1, wherein the thermoplastic polyurethane coated yarn is a thermoplastic polyurethane coated yarn having and outer diameter in a range of 0.1-5 mm.

* * * * *